US009556708B2

(12) United States Patent
Schneider et al.

(10) Patent No.: US 9,556,708 B2
(45) Date of Patent: Jan. 31, 2017

(54) DOWNHOLE STEAM GENERATOR CONTROL SYSTEM

(71) Applicant: World Energy Systems Incorporated, Fort Worth, TX (US)

(72) Inventors: Marvin J. Schneider, League City, TX (US); Blair A. Folsom, Santa Ana, CA (US); James C. Wright, Round Rock, TX (US); Anthony Gus Castrogiovanni, Manorville, NY (US); Andrew Henry Kasper, Pensacola, FL (US)

(73) Assignee: WORLD ENERGY SYSTEMS INCORPORATED, Fort Worth, TX (US)

( * ) Notice: Subject to any disclaimer, the term of this patent is extended or adjusted under 35 U.S.C. 154(b) by 316 days.

(21) Appl. No.: 14/186,998

(22) Filed: Feb. 21, 2014

(65) Prior Publication Data

US 2014/0284051 A1 Sep. 25, 2014

Related U.S. Application Data

(60) Provisional application No. 61/789,148, filed on Mar. 15, 2013.

(51) Int. Cl.

| | |
|---|---|
| ***E21B 36/02*** | (2006.01) |
| ***E21B 43/24*** | (2006.01) |
| ***F22B 1/22*** | (2006.01) |
| ***F22B 35/00*** | (2006.01) |

(52) U.S. Cl.

CPC ..... *E21B 36/02* (2013.01); *E21B 43/2406* (2013.01); *F22B 1/22* (2013.01); *F22B 35/00* (2013.01)

(58) Field of Classification Search

CPC ..... E21B 43/2406; E21B 36/02

See application file for complete search history.

(56) References Cited

U.S. PATENT DOCUMENTS

| | | | | |
|---|---|---|---|---|
| 4,078,613 | A * | 3/1978 | Hamrick | E21B 43/24 166/302 |
| 4,456,068 | A * | 6/1984 | Burrill, Jr. | E21B 36/02 166/266 |
| 4,648,835 | A * | 3/1987 | Eisenhawer | E21B 36/02 166/59 |
| 4,861,263 | A * | 8/1989 | Schirmer | E21B 36/02 166/59 |

(Continued)

FOREIGN PATENT DOCUMENTS

WO 2012/006258 A2 1/2012

OTHER PUBLICATIONS

PCT International Search Report and Written Opinion for Application PCT/US2014/017203, dated Aug. 29, 2014.

*Primary Examiner* — Shane Bomar

(74) *Attorney, Agent, or Firm* — Patterson & Sheridan, L.L.P.

(57) ABSTRACT

A control system for controlling the operation of a Downhole Steam Generator (DHSG) system includes a cascade control strategy for control of individual final control elements in communication with a local well master controller. The final control elements may control fuel, oxidant, feedwater, and/or carbon dioxide flow to the downhole steam generator. The local well master controller may monitor and adjust the flows to the DHSG to control the operating performance of the DHSG.

9 Claims, 3 Drawing Sheets

(56) References Cited

U.S. PATENT DOCUMENTS

| | | | | |
|---|---|---|---|---|
| 2007/0284107 | A1* | 12/2007 | Crichlow | E21B 43/166<br>166/302 |
| 2011/0127036 | A1 | 6/2011 | Tilmont et al. | |
| 2012/0318511 | A1 | 12/2012 | Dykstra et al. | |
| 2012/0323378 | A1* | 12/2012 | Dykstra | E21B 43/24<br>700/282 |
| 2013/0014940 | A1 | 1/2013 | Fripp et al. | |
| 2013/0180708 | A1* | 7/2013 | Ware | E21B 43/2406<br>166/246 |

* cited by examiner

DOWNHOLE STEAM GENERATOR CONTROL SYSTEM

CROSS REFERENCE TO RELATED APPLICATION

This application claims benefit of U.S. Provisional Application No. 61/789,148, filed Mar. 15, 2013, the contents of which are herein incorporated by reference in their entirety.

BACKGROUND OF THE INVENTION

Field of the Invention

Embodiments of the invention relate to a control system for controlling the operation of a downhole steam generator.

Description of the Related Art

Downhole steam generators are used to inject steam into heavy oil, extra heavy oil, or bitumen reservoirs at a location near the actual oil-bearing formation. These downhole steam generators generally have systems at the surface for supplying fuel, oxidant, and feedwater. These systems, however, are remote from the downhole steam generator and generally do not provide a means for optimizing performance based on actual measured process parameters.

Therefore, there is a need for new and improved control systems for optimizing the performance of downhole steam generators.

SUMMARY OF THE INVENTION

Embodiments of the invention generally include a control system for a downhole steam generator.

In one embodiment, a control system may comprise a local well master controller; a downhole steam generator incorporating a plurality of sensors for measuring operational characteristics of the downhole steam generator and communicating the measured operational characteristics to the local well master controller; and a plurality of flow control loops for controlling fluid flow to the downhole steam generator, wherein the local well master controller is configured to adjust individual flow control setpoints to set various fluid flows to the downhole steam generator to obtain a predetermined injection rate and steam quality.

In one embodiment, a method of controlling a downhole steam generator may comprise receiving measured operational characteristics of the downhole steam generator; calculating a firing rate demand based on the measured operational characteristics; communicating the firing rate demand to one or more control valves; and adjusting the control valves based on the firing rate demand to control various fluid flows to the downhole steam generator to obtain a predetermined injection rate and steam quality.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
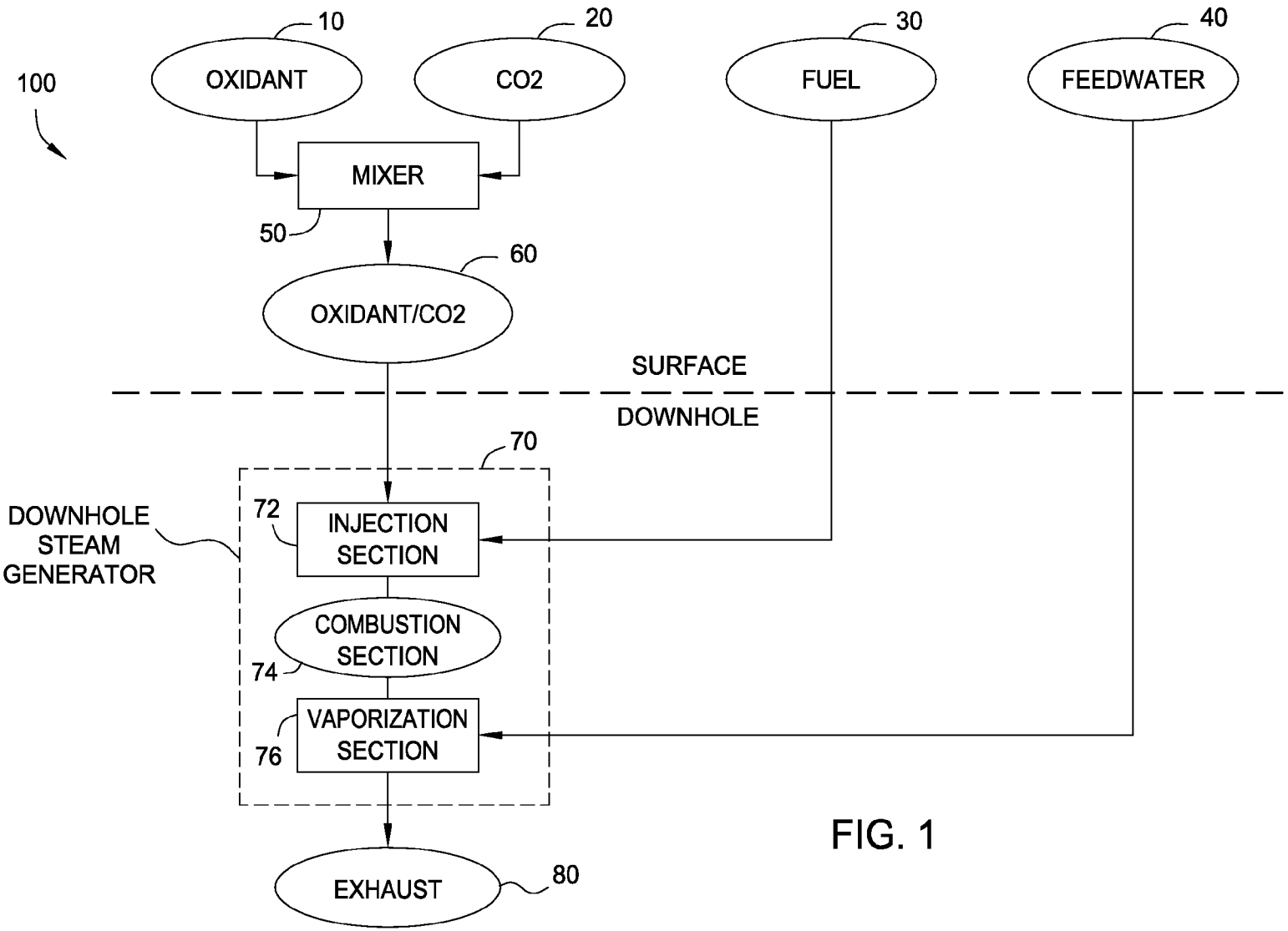
FIG. 1 illustrates a downhole steam generation system according to one embodiment.

FIG. 1 illustrates a downhole steam generation system 100, including components disposed at the surface and downhole. An oxidant supply 10, a carbon dioxide supply 20, a fuel supply 30, and a feedwater supply 40 may be disposed at the surface for supplying fluids to a downhole steam generator (DHSG) 70 disposed in a wellbore. A mixer 50 may also be disposed at the surface for mixing fluids from the oxidant supply 10 and the carbon dioxide supply 20 (including recycled carbon dioxide for example) prior so sending the combined oxidant/carbon dioxide fluid 60 to the DHSG 70. In one embodiment, the oxidant supply 10 and the carbon dioxide supply 20 may not be mixed at the surface and may be supplied separately and directly to the DHSG 70 through two separate injection lines. In one embodiment, the local carbon dioxide mixer 50 may be omitted, and the carbon dioxide may be pre-mixed with the oxidant at a central plant.

Although one or more embodiments are described herein as using carbon dioxide from a carbon dioxide supply 20, the downhole steam generation system 100 may be supplied with other diluents, solvents, and/or inert gases that do not participate in the reactions occurring within the DHSG 70. Nitrogen is one example of an inert gas that may be used instead of or in combination with carbon dioxide and/or any other inert gases that do not participate in the reactions occurring within the DHSG 70. Although described herein as using a feedwater supply 40 (including preheated feedwater for example), the DHSG system 100 may be supplied with steam. The oxidant supply 10 may be configured to supply air, oxygen, oxygen-enriched air, and/or other similar types of oxidants. The fuel supply 30 may be configured to supply hydrogen, methane, syngas, and/or other similar types of fuels.

In one embodiment, the DHSG 70 may be supported from the surface by a wellhead via one or more conduits/lines for providing operating elements to and from the DHSG 70, as well as one or more conduits/lines for communicating mechanical, electrical, and/or hydraulic signals to and from the DHSG 70. The process fluid streams may include, but are not limited to, water, steam, air, oxygen, carbon dioxide, hydrogen, nitrogen, methane, syngas, nanocatalyst, nanoparticles, fracturing materials, proppants, and/or any other materials that may positively or negatively affect a formation, a reservoir within the formation, and/or hydrocarbons within the reservoir. The signals may correspond to pressure, temperature, flow rate, etc., as required by the control strategies of the control system.

The DHSG 70 may include an injection section 72, a combustion section 74, and a vaporization section 76. The injection section 72 may include burner head assembly for combining and/or igniting the fuel and oxidant (and any other fluids mixed with the fuel and/or oxidant). The combustion section 74 may include a combustion chamber for supporting the combustion of the fuel and oxidant. The vaporization section 76 may include an assembly for injecting and mixing the feedwater or steam into the combustion products to generate higher quality steam. An exhaust 80 comprising steam, combustion products, and/or other exhaust gases may be injected out of the DHSG 70 and into one or more hydrocarbon bearing reservoirs.

Although the embodiments described herein relate to the DHSG 70, embodiments of the invention may be used with any other types of downhole tools. One example of a DHSG that may be used with the embodiments described herein is shown and described as DHSG 10, 100 in U.S. Pat. No. 8,387,692, filed on Jul. 15, 2010. Another example of a DHSG that may be used with the embodiments described herein is shown and described as system 1000 in U.S. Patent Application Publication No. 2011/0214858, filed on Mar. 7, 2011. The contents of each of the above referenced patent application publications are herein incorporated by reference in their entirety.

Figure 2:
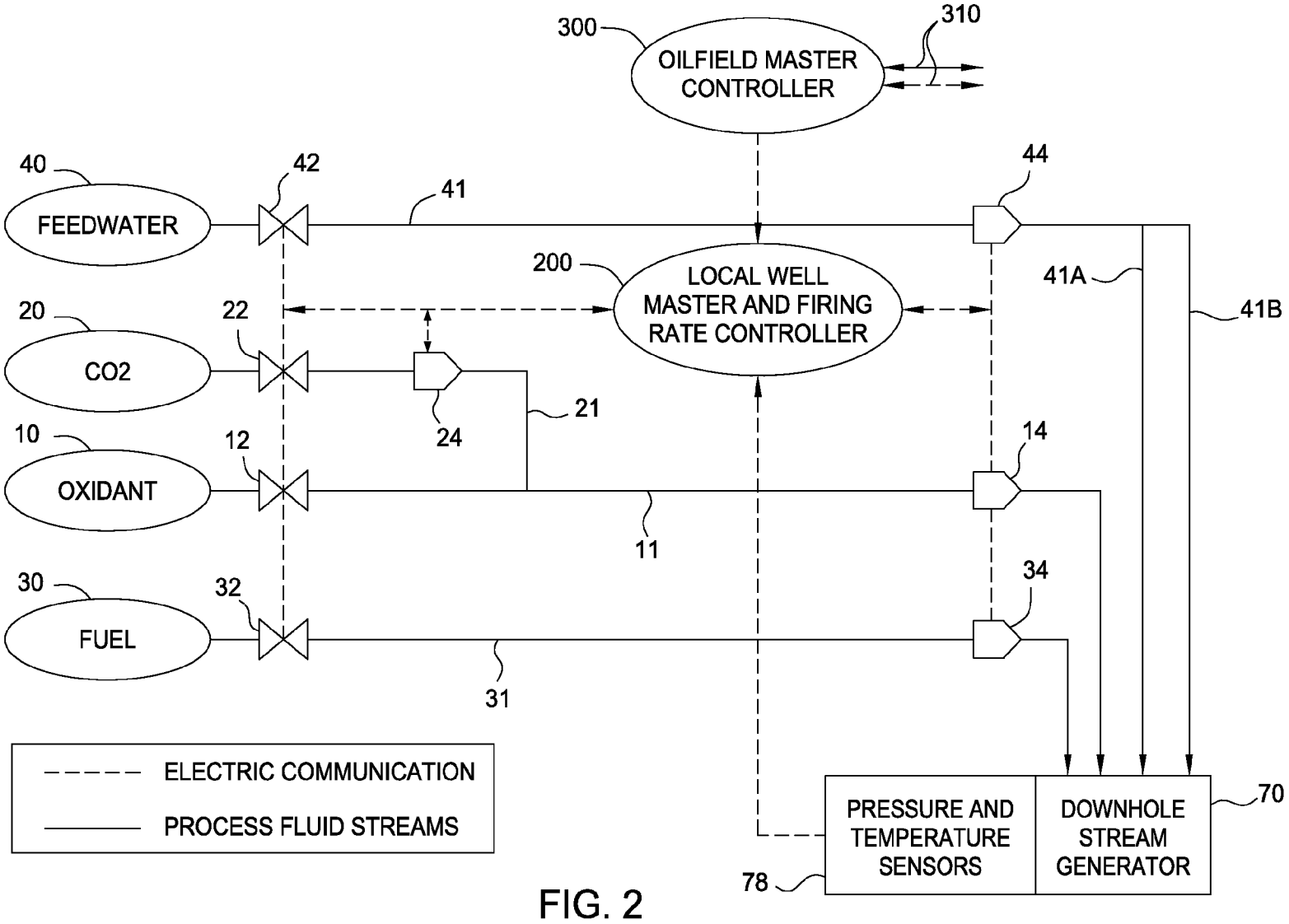
FIG. 2 illustrates a control system for the downhole steam generation system according to one embodiment.

FIG. 2 illustrates a control system 1000 for the DHSG system 100. The control system 1000 may include an oilfield (regional master) controller 300 and a local well master and firing rate controller 200 for controlling the feedwater, carbon dioxide, oxidant, and fuel supplied to the DHSG 70 via one or more supply lines 11, 21, 31, 41. The supply lines 11, 21, 31, 41 may include at least one pressure control valve 12, 22, 32, 42 for controlling the fluid pressure in each line. The supply lines 11, 21, 31, 41 may also include at least one flow rate control valve 14, 24, 34, 44 for controlling the fluid flow rate through each line. The flow rate control valves 14, 24, 34, 44 and their individual controllers may comprise a package of cascaded feedback and feedforward control loops which are part of an integrated overall control strategy that communicates with the local master controller 200. Ratio control of relative flow rates among flow controllers of control valves 14, 24, 34, 44 may be incorporated. In one embodiment, the feedwater flow lines may be split and sized down into two separate lines and control valves 41A, 41B to maintain a stable pressure turndown. In one embodiment, the carbon dioxide, oxidant, and/or fuel gas lines may be separated and sized into one or more lines for supplying these components to the DHSG 70. Each flow line may include one or more flow controllers and flow control valves 14, 24, 34, 44 in communication with the local master controller 200.

The local master controller 200 may communicate with and control the pressure control valves 12, 22, 32, 42 and/or the flow rate control valves 14, 24, 34, 44 to optimize the performance of the DHSG 70 based on actual operational characteristics. The DHSG 70 may include one or more sensors 78 for measuring operational characteristics of the DHSG 70. The operational characteristics may include temperatures, pressures, flow rates, volumes, generation of steam, and/or the type, volume, quantity, and/or quality of any reactant/injectant materials, e.g. operating elements, flowing into and/or out of the DHSG 70. The sensors 78 may include, but are not limited to, pressure, temperature, flow, acoustic, electromagnetic, NMR, nuclear, density, and/or fluorescent detector sensors. In one embodiment, the sensors 78 may measure pressure and temperature at the combustion section 74 and at the tail end of the vaporization section 76. The local master controller 200 is operable to retrieve and/or receive electronic signals from the sensors 78 corresponding to the measured operational characteristics of the DHSG 70.

The regional master controller 300 may communicate with and provide a setpoint to the local well master controller 200. The regional master controller 300 may also communicate with and control one or more other local master controllers controlling downhole steam generators in the same or similar oilfield(s) via communication lines 310. The regional master controller 300 may also communicate with and control one or more other regional master controllers controlling local master controllers in the same or similar oilfield(s). The oil field master controller 300 may be configured to control one or more DHSGs 70.

Figure 3:
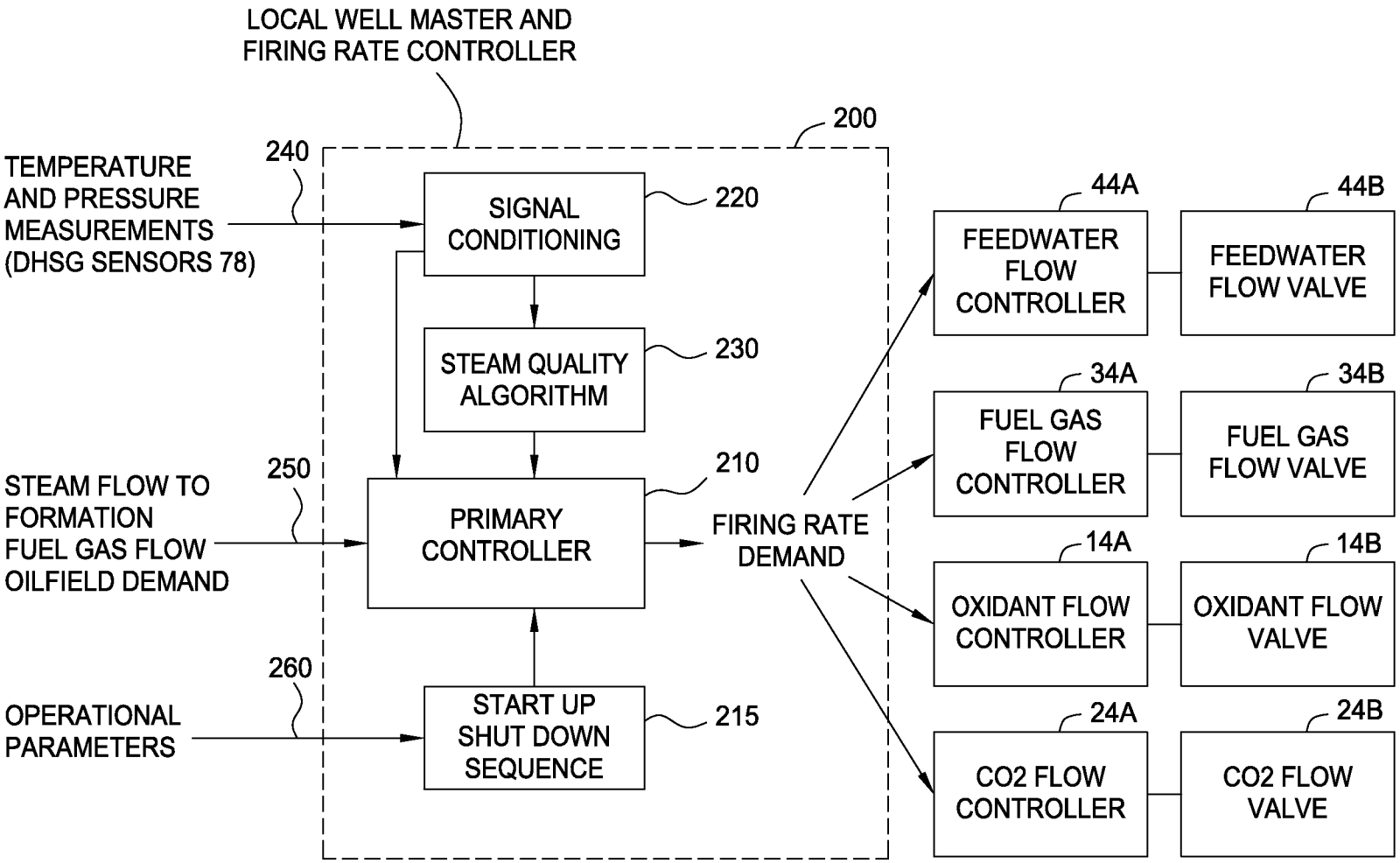
FIG. 3 illustrates the control system according to one embodiment.

FIG. 3 illustrates one or more inputs 240, 250, 260 communicated to the local master controller 200 for calculating and communicating firing rate demands to individual flow controllers 14A, 24A, 34A, 44A that control and adjust flow valves 14B, 24B, 34B, 44B to control the oxidant, carbon dioxide, fuel, and feedwater flows supplied to the DHSG 70 to optimize the operational performance of the DHSG 70.

The local master controller 200 may include one or more programmable central processing units operable with memory, mass storage devices, input/output controls, and/or display devices. The controller 200 may include support circuits such as power supplies, clocks, cache, and/or input/output circuits. The controller 200 may be operable to process, store, analyze, send, and/or receive data from and control one or more sensors 78, controllers 14A, 24A, 34A, 44A, 300, and/or other devices via wired and/or wireless communication. The controller 200 may be configured with software/algorithms that process input signals/commands to generate output signals/commands based on operational characteristics of one or more DHSGs 70. The controller 200 may control one or more DHSGs 70 operation based on input/output and/or pre-programmed knowledge derived from reservoir/well analysis, the DHSGs 70 performance, and/or the regional master controller 300.

As illustrated in FIG. 3, the local master controller 200 may include a primary controller 210, signal conditioning control 220, a water vapor fraction (steam quality) algorithm 230, and start-up and/or shut-down sequence control logic 215. The local master controller 200 provides autonomous, automatic control of the DHSG 70 based on local operating performance setpoints adjusted by an operator or by remote operating performance setpoints from the regional master controller 300. In addition to providing a firing rate demand for the feedwater, fuel, oxidant, and carbon dioxide flows, the local master controller 200 is operable to provide a water vapor fraction (steam quality) calculation and control via oxidant, feedwater, and/or fuel trim flow demand; a compensated feedwater flow demand based on water from combustion; a metered and cross limited demand for fuel and oxidant flow; an adjustable setpoint for surplus oxygen at the DHSG 70 tailpipe; and a flow control ratio for carbon dioxide (or other inert gas) dilution flow on steam assisted gravity drainage wells, drive wells, and/or other well patterns and formations known in the art.

The local master controller 200 is operable to adjust, such as increase or decrease (e.g. trim), at least one of the oxidant, feedwater, and fuel gas flows, while maintaining the remaining oxidant, feedwater, and fuel gas flows at a constant rate to achieve a desired water vapor fraction. For example, the feedwater and fuel gas flows may be maintained at a constant rate while the oxidant flow rate is adjusted. In another example, the oxidant and fuel gas flows may be maintained at a constant rate while the feedwater flow rate is adjusted. In another example, the oxidant and feedwater flows may be maintained at a constant rate while the fuel gas flow rate is adjusted.

One of the inputs 250 communicated to the local master controller 200 is a calculated or desired amount of steam flow to the formation in barrels per day. Other inputs 250 may include the flow rate of the fuel, oxidant, feedwater, and/or inert gases, and/or an oilfield operating performance demand. The local master controller 200 may further include a bias control that provides a means to bias an individual well's participation to balance the steam delivery and/or oilfield demand against individual DHSGs 70 capabilities or constraints. These inputs 250 and/or bias control can be adjusted and/or programmed into the local master controller 200 by an operator locally and/or can be communicated remotely from the regional master controller 300.

The local master controller 200 may follow one or more start-up and/or shut-down sequences from the control 215. Start-up sequences may include incrementally increasing the operating performance of the DHSG 70 for a predetermined amount time, or operating the DHSG 70 at a specific operating index for a first period of time and thereafter adjusting the operating index to an oilfield performance demand. These operational parameters 260 may be provided by an operator local to the local master controller 200 and/or from the regional master controller 300. In one embodiment, the local master controller 200 may be configured to continuously monitor and operate under the start-up sequence until receiving an operational parameter such as achieving stable combustion and/or combustion chamber inner wall temperature as measured by the sensors 78.

The start-up sequences may trigger one or more types of ignition arrangements of the DHSG 70, including but not limited to pyrophoric, hypergolic, and combustion/detonation wave ignition methods, as well as plasma arc torch, igniter torch (natural gas/air or natural gas/enriched air), hydrogen/air torch, hot wire, glow plug, spark plug, and/or other similar ignition devices.

The DHSG 70 temperature and pressure measurements from the sensors 78 (e.g. DHSG tailpipe exit temperature and pressure) may be used with other process variable inputs to provide a calculated water vapor fraction (steam quality) signal via the steam quality algorithm 230 to the primary controller 210. Signal conditioning capability 220 may be provided to add the necessary filters, conversions, interpolations, bias, etc. to condition the input signals 240 for stable control loop operation. The primary controller 210 may in turn provide a steam quality trim signal to the oxidant flow controller 14A to adjust the oxidant flow valve 14B and thus control the amount of oxidant flow to the DHSG 70. A specified target water vapor fraction (steam quality) may be operator adjustable using local setpoints of the primary controller 210. Target water vapor fraction (steam quality) for delivery to the formation may be 60%-100%, 70%-90%, 80%-85%, or any other specific point between these ranges, irrespective of the actual steam flow rate to the formation.

In one embodiment, the (pressure/temperature) sensors 78 on the DHSG 70 may include triple-redundant transmitters in a standard 2 out of 3 fail-over scheme. If one sensor 78 fails or deviates by more than a specified percentage, such as 10%, from the measurement of the adjacent transmitter, the controller 210 may switch from the average of all three transmitters to the average of the remaining two transmitters and a transmitter fail alarm may be activated. If the second of three transmitters is lost or deviates by more than a specified percentage, such as 10%, from its remaining counterpart, a DHSG 70 shutdown may be initiated by the controller 210. In the event all three pressure transmitters fail, but a temperature signal is still available, a subroutine in the primary controller 210 may be used to calculate a downhole pressure with which to continue operation.

Empirically and/or analytically derived water vapor fraction (steam quality) look-up tables or other performance references may be derived from the DHSG 70 tailpipe exit pressure measurements in combination with reactant flow rates and/or tailpipe measurements. Multiple tables or performance references may be generated, e.g. one for SAGD wells burning a 70%/30% carbon dioxide/oxidant mix for a nominal 0.5% surplus O2 at the DHSG 70 tailpipe exit; and one for Drive wells burning a 55%/45% CO2/O2 carbon dioxide/oxidant mix for a nominal 5% surplus O2 at the DHSG 70 tailpipe exit. Similarly, empirically and/or analytically derived water vapor fraction (steam quality) look-up tables or other performance references may be generated for air, oxygen, oxygen-enriched air, and/or other similar types of oxidants, as well as other diluents, solvents, and/or inert gases, such as nitrogen, and various combinations thereof.

A calculated water vapor fraction (steam quality) is obtained from the steam quality algorithm 230, which may comprise an empirically derived heat balance model and steam quality predictor. The steam quality predictor may be a multivariable input mathematical model. The heat balance model and steam quality predictor may receive multiple inputs 240, including the DHSG 70 tailpipe exit temperature and pressure, fuel flow, oxidant flow, carbon dioxide flow, and feedwater flow to provide a calculated DHSG 70 tailpipe exit steam quality. In one embodiment, the water vapor fraction (steam quality) calculation may be based on actual pressure and/or temperature measurements at the DHSG 70 tailpipe exit (and/or any other locations along/within the DHSG 70). In one embodiment, the water vapor fraction (steam quality) calculation may be based on actual pressure measurements from the DHSG 70, while using a calculated temperature input. In one embodiment, the water vapor fraction (steam quality) calculation may be based on actual temperature measurements from the DHSG 70, while using a calculated pressure input. In one embodiment, the water vapor fraction (steam quality) may be calculated based on measurements of pressure, temperature, and/or reactant/input (e.g. oxidant, fuel gas, feedwater, inert gas) flow rates using equilibrium and/or finite rate chemistry models to predict the water vapor fraction (steam quality) in the tailpipe of the DHSG 70. A secondary output of the steam quality algorithm 230 may be the actual steam temperature. The outputs from the steam quality algorithm 230 may be used to send one or more firing rate demands to the controllers 14A, 24A, 34A, 44A to maintain and/or achieve a desired DHSG 70 operating performance.

In one embodiment, the water vapor fraction (steam quality) calculation may be modified to account for a water/steam mixture that includes various other exhaust gases exiting the tailpipe of the DHSG 70. Pressure and temperature measurements at the DHSG 70 tailpipe should be enough to determine the thermodynamic state of the exhaust 80 fluid mixture. As is the case in a mixture containing two or more substances with one or more existing in a two-phase state, phase change does not occur at a constant temperature as it does in single component systems since the partial pressure of the vapor-phase component (e.g. steam) of the evaporating fluid (e.g. feedwater) changes as more vapor (or steam) is created. The aforementioned water vapor fraction (steam quality) algorithm accounts for all of the gas phase products and the associated partial pressure of steam when calculating the steam quality of the exhaust 80.

The feedwater, fuel, oxidant, and carbon dioxide flows may be measured by the flow meters serving flow valves 14B, 24B, 34B, 44B to provide direct mass flow, density, temperature, and/or pressure signals to the local master controller 200. For each of the flows (feedwater, fuel, oxidant, carbon dioxide) at least two control valves 14, 24, 34, 44 may be provided in a standard split-range scheme utilizing a low range and a high range control valve in parallel. Some prescribed flow overlap between the top end of the low range valve and the low end of the high range valve may be provided. This methodology may ensure maximum flow control precision and the ability to achieve the design requirement for at least a 10:1 flow turndown ratio.

A load and firing rate demand from the primary controller 210 may be provided to the feedwater, fuel, oxidant, and carbon dioxide controllers 14A, 24A, 34A, 44A via individual setpoint characterization interpolation tables. These tables may establish for any given firing rate demand the fuel flow, oxidizer flow, feedwater flow, and/or carbon dioxide flow required to establish the required steam flow to the formation. These tables may be empirically derived from actual DHSG firing rate test data at each 10% (or other specified percentage) load increment from minimum stable load to the maximum continuous loading of the DHSG 70.

In one embodiment, cross limiting of the fuel and oxidant flows for safe (e.g. non-fuel rich firing) of the DHSG 70 may be provided by the primary controller 210. A single-input or two-input look-up table or other performance reference may provide the oxidant flow required for the measured amount of fuel being burned (oxidant for fuel), which may be communicated to the oxidant flow controller 14A. The oxidant flow controller 14A may choose the higher of two signals, firing rate demand plus steam quality trim, or oxidant for fuel plus a small trim bias. A second single-input or two-input table or other performance reference may provide the fuel flow required for the measured oxidant flow (fuel for oxidant) plus a small trim bias, which may be communicated to the fuel flow controller 34A. The fuel flow controller 34A may choose the lower of two signals, firing rate demand or the biased fuel for oxidant signal. By this methodology the fuel and oxidant are cross-limited in such a way as to assure that oxidant flow always leads (increases first) on increasing demand and fuel flow always leads (decreases first) on decreasing demand. The two interpolation tables or other performance references for fuel and oxidant cross-limiting each have a second input to allow limited fuel/oxidant ratio adjustment by an operator.

In one embodiment, the local master controller 200 may include a water-from-combustion calculator that receives inputs from the fuel, oxidant, carbon dioxide, and/or feedwater controllers 14A, 24A, 34A, 44A. The combustion calculator may provide a mole fraction calculated water-from-combustion flow. This water-from-combustion may be assumed to be at saturation temperature for the measured discharge pressure at the DHSG 70 tailpipe exit. The additional water flow may be subtracted from the feedwater flow setpoint derived from firing rate demand to provide a corrected feedwater flow setpoint to the feedwater flow controller 44A. The water-from-combustion flow may be added to the measured feedwater flow, and their pressure and temperature weighted values may be volumetrically summed and converted to an equivalent volumetric steam flow at the actual steam temperature calculated by the steam quality algorithm 230. This steam flow value may be provided as an input 250 to the primary controller 210. Similarly, a mole fraction calculated water-from-combustion may be determined for operation using air, oxygen, oxygen-enriched air, and/or other similar types of oxidants, as well as other diluents, solvents, and/or inert gases, such as nitrogen, and various combinations thereof.

While the foregoing is directed to embodiments of the invention, other and further embodiments of the invention may be devised without departing from the basic scope thereof, and the scope thereof is determined by the claims that follow.

The invention claimed is:

1. A method of controlling a downhole steam generator, comprising:

supplying a fuel, an oxidant, and feedwater to the downhole steam generator;

flowing the fuel, the oxidant, and the feedwater through at least one flow rate control valve, wherein the flow rate control valve includes a flow controller and a flow valve;

combusting the fuel and the oxidant in the downhole steam generator;

measuring operational characteristics of the downhole steam generator;

communicating the measured operational characteristics of the downhole steam generator to a firing rate controller;

calculating a firing rate demand using the firing rate controller based on the measured operational characteristics;

communicating the firing rate demand to the flow controller; and adjusting the flow valve using the flow controller based on the firing rate demand to control flow of at least one of the fuel, the oxidant, and the feedwater to the downhole steam generator to obtain a predetermined injection rate and steam quality.

2. The method of claim 1, further comprising calculating the firing rate demand based on at least one of a steam flow to formation input, a flow rate input, and an oilfield demand input.

3. The method of claim 1, further comprising supplying carbon dioxide to the downhole steam generator, flowing the carbon dioxide through the at least one flow rate control valve, and adjusting the flow valve using the flow controller based on the firing rate demand to control the flow of at least one of feedwater, carbon dioxide, oxidant, and fuel to the downhole steam generator.

4. The method of claim 3, further comprising adjusting at least one of the feedwater, carbon dioxide, oxidant, and fuel flow to the downhole steam generator while maintaining the remaining feedwater, carbon dioxide, oxidant, and fuel flows at a constant rate.

5. The method of claim 3, further comprising calculating the firing rate demand based on a start up sequence or a shut down sequence and adjusting the flow valve using the flow controller based on the firing rate demand to control the flow of at least one of feedwater, carbon dioxide, oxidant, and fuel to the downhole steam generator.

6. The method of claim 1, wherein the measured operational characteristics include one or more of temperatures, pressures, flow rates, volumes, generation of steam, and type, volume, quantity, and/or quality of reactant/injectant materials.

7. The method of claim 1, further comprising receiving input from an oilfield master controller and in response adjusting the flow valve using the flow controller to control the flow of at least one of feedwater, oxidant, and fuel to the downhole steam generator to obtain the predetermined injection rate and steam quality.

8. The method of claim 1, wherein calculating the firing rate demand comprises calculating steam quality based on at least the measured operational characteristics.

9. The method of claim 1, wherein adjusting the flow valve using the flow controller based on the firing rate demand to control flow of at least one of fuel, oxidant, and feedwater includes increasing or decreasing a flow rate of at least one of the fuel, the oxidant, and the feedwater to the downhole steam generator.

* * * * *